US008695701B2

(12) United States Patent
Constantinou et al.

(10) Patent No.: US 8,695,701 B2
(45) Date of Patent: Apr. 15, 2014

(54) MEASUREMENT DEVICE IN A HORIZONTAL WELL

(75) Inventors: Georges Constantinou, La Varenne Saint Hilaire (FR); Chistian Wittrisch, Rueil Malmaison (FR)

(73) Assignees: Institut Francais du Petrole, Rueil-Malmaison (FR); Vinci Technologies, Nanterre (FR)

( * ) Notice: Subject to any disclaimer, the term of this patent is extended or adjusted under 35 U.S.C. 154(b) by 420 days.

(21) Appl. No.: 12/519,181

(22) PCT Filed: Dec. 10, 2007

(86) PCT No.: PCT/FR2007/002041

§ 371 (c)(1), (2), (4) Date: Dec. 23, 2009

(87) PCT Pub. No.: WO2008/087282

PCT Pub. Date: Jul. 24, 2008

(65) Prior Publication Data

US 2010/0089567 A1 Apr. 15, 2010

(30) Foreign Application Priority Data

Dec. 15, 2006 (FR) ..... 06 10993

(51) Int. Cl.
*E21B 17/10* (2006.01)

(52) U.S. Cl.
USPC ..... 166/241.1

(58) Field of Classification Search
USPC ..... 367/25; 73/596; 181/105; 166/322, 323, 166/241.1, 241.5, 332.1, 316, 364, 332.8; 175/220
See application file for complete search history.

(56) References Cited

U.S. PATENT DOCUMENTS

| | | | | | |
|---|---|---|---|---|---|
| 3,066,693 | A | * | 12/1962 | Taylor, Jr. | 137/454.2 |
| 3,446,237 | A | * | 5/1969 | Haley | 137/463 |
| 4,220,176 | A | * | 9/1980 | Russell | 137/496 |
| 4,376,464 | A | * | 3/1983 | Crow | 166/324 |
| 4,510,797 | A | * | 4/1985 | Guidry et al. | 340/856.2 |
| 5,871,052 | A | * | 2/1999 | Benson et al. | 166/386 |
| 5,927,402 | A | * | 7/1999 | Benson et al. | 166/65.1 |
| 6,755,257 | B2 | | 6/2004 | Spencer et al. | |
| 2007/0295502 | A1 | * | 12/2007 | Watson et al. | 166/254.2 |

FOREIGN PATENT DOCUMENTS

EP 0 860 902 A2 8/1998

OTHER PUBLICATIONS

Opinion of PCT/FR2007/002041 dated Jul. 13, 2009.

* cited by examiner

*Primary Examiner* — Giovanna Wright
*Assistant Examiner* — Ronald Runyan
(74) *Attorney, Agent, or Firm* — Antonelli, Terry, Stout & Kraus, LLP.

(57) ABSTRACT

A logging probe supporting device includes a connector that can be plugged in at the bottom of the well with a logging cable contained in the inner space of rods to which the supporting device is fastened and fluid communicating openings provided between the inner space of the rods and the outside of the supporting device, the openings being arranged between the probe and connector. The device includes, between the openings and the connector, a shutoff such as check valves allowing fluid circulation from the inside towards the outside and preventing circulation from the outside towards the inside of the supporting device.

10 Claims, 2 Drawing Sheets

PRIOR ART

MEASUREMENT DEVICE IN A HORIZONTAL WELL

FIELD OF THE INVENTION

The present invention relates to the sphere of hydrocarbon reservoir development, in particular to horizontal wellbores wherein measurements or logging type measurements are to be performed in a well. The techniques currently used involve drawbacks when the wells are drilled in rocks under high pressure or when control of reservoir fluid inflows is difficult. This is notably the case in some reservoirs at great depth or in formations buried under a great water depth.

BACKGROUND OF THE INVENTION

Figure 1:
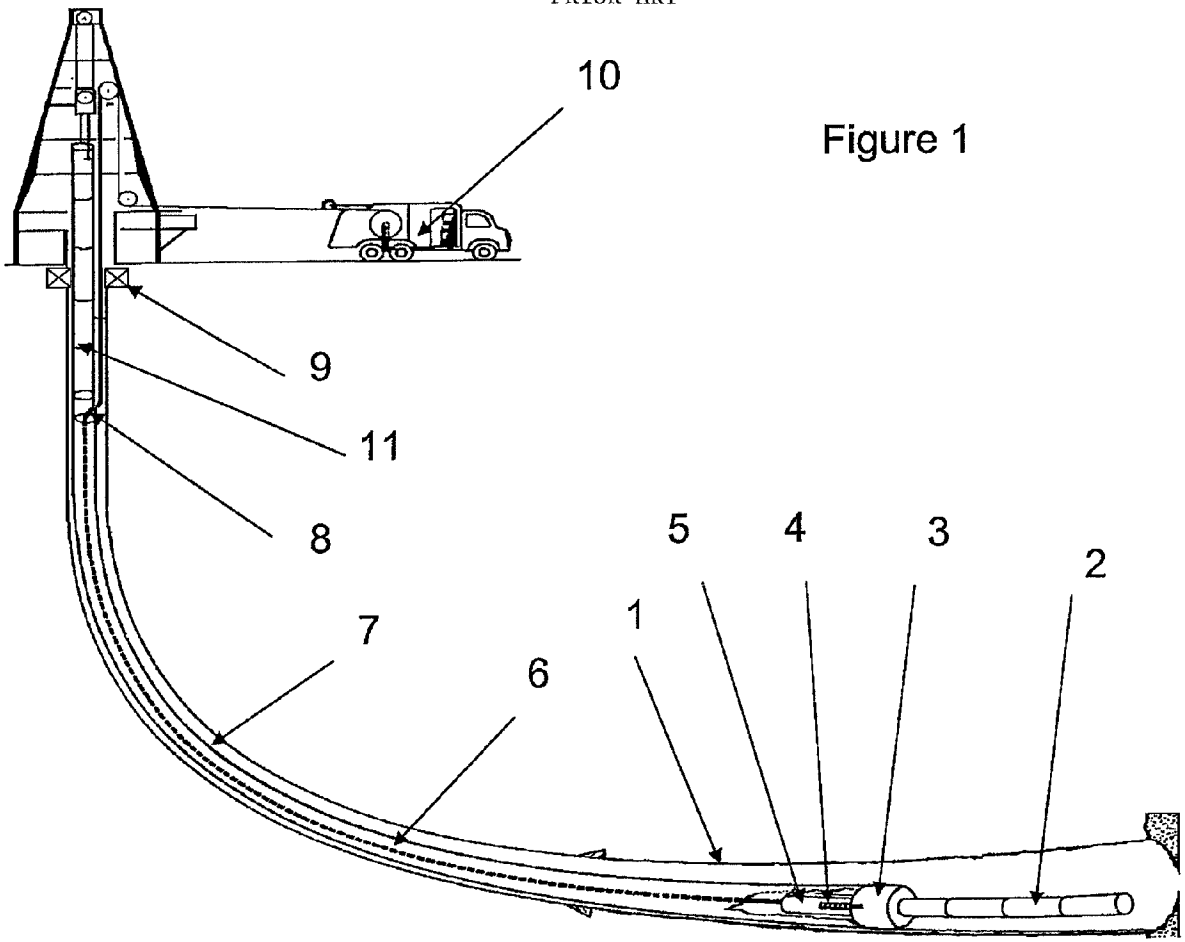

FIG. 1 describes an example of a logging installation in a horizontal well 1. A probe supporting device 3 comprises a male electrical connector 4 connected by conductors to logging probes 2. A load bar 5 comprising at its lower end a female electrical connector is lowered in drill string 7 by means of an electrical cable 6 referred to as logging cable. The load bar and the cable are displaced through pumping in the highly deflected part of the well until they reach the male connector of the probe supporting device. Connection between the two elements of the electrical connector provides electrical continuity between the logging probes and surface recording equipment 10. Once the female connector in place on the male connector, the operators screw on a side-entry sub 8 allowing to pass the logging cable into the annular space between the well and the string. Thus, descent and/or displacement of the probes is achieved by assembling or by removing drill string pipes 11. Reference number 9 relates to the conventional well shutoff means the wellhead is equipped with.

During the logging operation using a drill string, the pressure of the fluid in the geologic formation is balanced by the hydrostatic pressure of the fluid, notably the drilling fluid, contained in the rods and outside the rods.

In case of unbalance, sudden fluid inflows from the formation can be difficult to control. Fluid upwelling through the annulus can be controlled by seal assembly 9.

Fluid upwelling can however occur through the inside of the drill rods. In fact, the logging systems currently used allow circulation of the drilling fluid, notably to cool the well, to renew the drilling fluid, maintain the pressure balance with the geologic formation crossed, and also to pump and displace the load bar in the inner space of the drill rods. The equipment currently used allows free circulation in both directions within the drill string.

The object of the present invention is to overcome risks of sudden circulation, in the opposite direction from the bottom upwards, within the rods during horizontal logging operations, because such circulation may notably cause a blowout at the surface or disconnection of the male and female connectors.

SUMMARY OF THE INVENTION

The invention thus relates to a logging probe supporting device comprising connecting means that can be plugged in at the bottom of the well with a logging cable contained in the inner space of rods to which the supporting device is fastened, fluid communication means between the inner space of the rods and the outside of the supporting device, said communication means being arranged between the probe and the connecting means. The device comprises, between the communication means and the connecting means, shutoff means such as check valves allowing fluid circulation from the inside towards the outside and preventing circulation from the outside towards the inside of the supporting device.

The shutoff means can comprise a tilting shutter.

The shutoff means can comprise a piston type shutter.

A line can provide pressure balance of the connecting means and the means intended for electrical connection with the probe.

Return means can keep the shutoff means closed.

A locking means can keep the shutoff means open.

The locking means can be actuated manually.

BRIEF DESCRIPTION OF THE SEVERAL VIEWS OF DRAWINGS

Figures 2A, 2B, 3A, 3B:
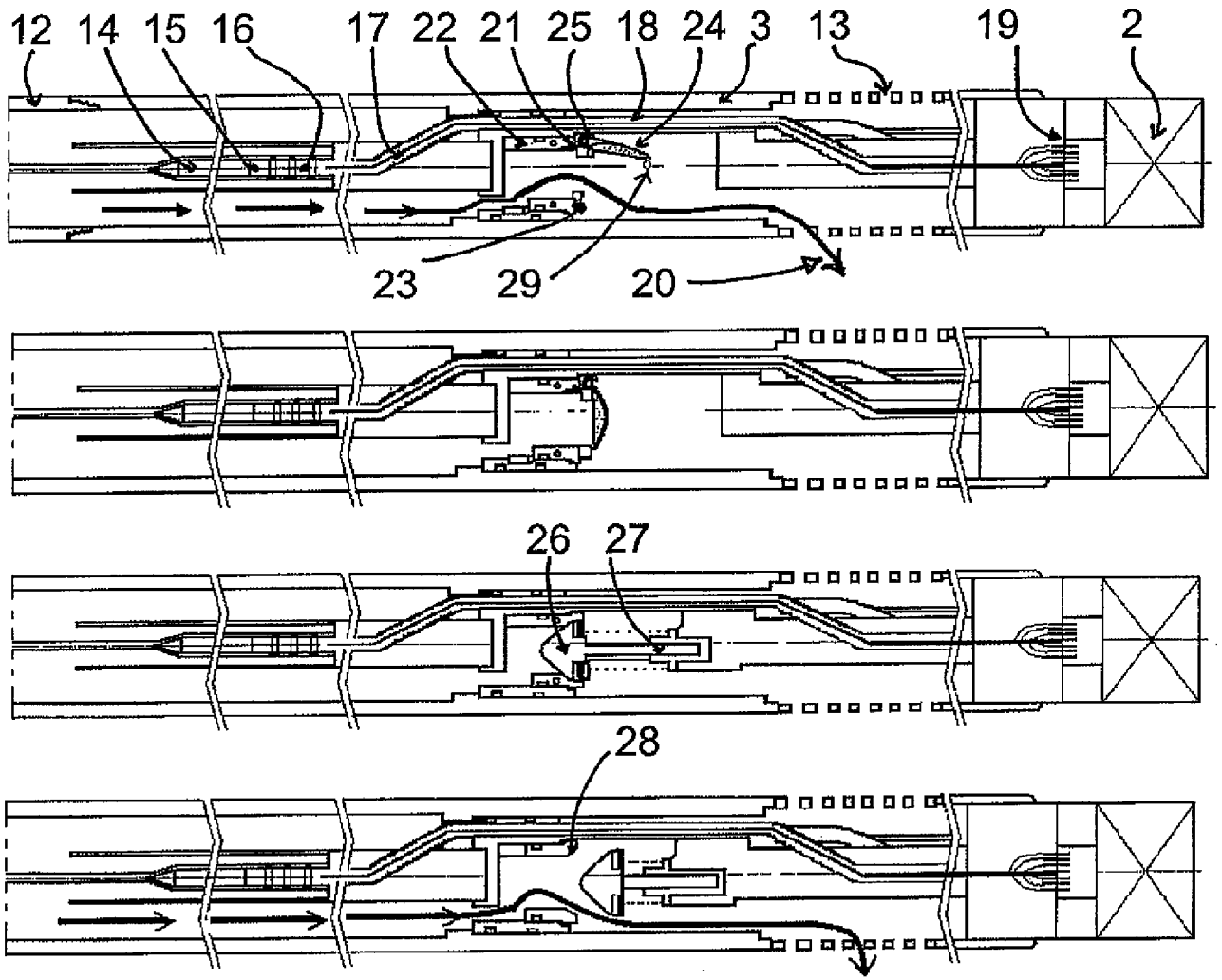

Other features and advantages of the present invention will be clear from reading the description hereafter, with reference to the accompanying figures wherein:

FIG. 1 describes a system according to the prior art,

FIGS. 2*a* and 2*b* describe the probe supporting device according to the invention, FIGS. 3*a* and 3*b* describe a variant according to the invention.

DETAILED DESCRIPTION OF THE INVENTION

FIG. 2*a* is a diagrammatic cross-sectional view of an embodiment of the device according to the invention. Reference number 2 relates to the logging probe mechanically linked to the body of supporting device 3 by conventional mechanical means, flange, nut or equivalent means. The body of supporting device 3 is fastened to the lower end of a string of tubulars 12 allowing to operate the logging probes in a well. Electrical connecting means 14 comprise a female connector 15 assembled to load bars operated in the inner space of rods 12 through a logging cable. In the figures, the female connector is plugged onto male connector 16. In order to provide electrical connection of probe 2, a bundle of electric links 17 runs through a line 18 up to electrical contactors 19 with probe 2. It can be noted that, up to contacts 19, the electric bundle is subjected to the same pressure as the electrical connecting means 14.

The body of supporting device 3 comprises openings 13 in form of grids or bores of suitable dimensions for preventing inner clogging by debris. Thus, circulation of a fluid through pumping through the inside of rods 12 can be achieved in the direction shown by arrows 20. This circulation is established to displace through pumping female connector 15 for connection, or to clean the well using the ascending circulation in the well of a suitable fluid.

According to the invention, a shutoff means of check valve type is inserted between circulation openings 13 and the connecting means. This shutoff means is achieved by incorporating in the body of the probe supporting device a cylinder 22 carrying an annular seat 23 on which closes a shutter 24 that swings onto a hinge 25. A return spring mounted on the hinge joint holds the shutter in closed position on the seat. The cylinder of the shutoff means is tightly assembled in the inner bore of the body of the probe supporting device. The seals are not shown in the figures. Thus, the fluid can circulate in the inner direction of the rods towards the outside of the probe supporting device, the valve allowing fluid to freely flow in this direction.

FIG. 2*b* shows the shutoff means closed by the shutter shut on the seat. Circulation cannot occur in the outer direction of the probe supporting device towards the inside of the rods. This circulation, referred to as reverse circulation, is therefore prevented.

FIGS. 3*a* and 3*b* show another embodiment of the shutoff means wherein the shutter comes in form of a piston 26 that moves longitudinally on a rod 27 to clear the passage under the action of the direct circulation, or to provide sealing on a seat 28 under the action of a return means and of the reverse circulation.

In FIG. 2*a*, reference number 29 relates to a latch that holds the shutter open if it is desired to use a probe supporting device without making the check valve type shutoff means inoperative. This latch is set manually prior to assembling the probe supporting device on the operating rods. The shutoff means variant according to FIGS. 3*a* and 3*b* can also be equipped with an equivalent system.

The invention claimed is:

1. A logging probe supporting device comprising connecting means that can be plugged in at the bottom of the well with a logging cable contained in the inner space of rods to which said supporting device is fastened, electric links running inside of the supporting device from the connecting means towards an end configured to be connected to the logging probe, fluid communication means between the inner space of the rods and the outside of the supporting device, said fluid communication means being arranged between the probe and the connecting means, and a tilting shutter, provided between the fluid communication means and the connecting means, allowing fluid circulation from the inside towards the outside while preventing circulation from the outside towards the inside of the supporting device, wherein the electric links run past an area of the tilting shutter between an outer periphery of the tilting shutter and an outer body wall of the supporting device.

2. The device as claimed in claim 1, wherein a line provides pressure balance of the connecting means and means intended for electrical connection with the probe.

3. The device as claimed in a claim 1, further comprising return means to keep the tilting shutter closed to prevent circulation from the outside towards the inside of the supporting device.

4. The device as claimed in claim 1, further comprising a locking means that can be set to keep the tilting shutter open.

5. The device as claimed in claim 4, wherein said locking means is actuated manually.

6. A logging probe supporting device comprising an electrical connector that can be plugged in at the bottom of the well with a logging cable contained in the inner space of rods to which said supporting device is fastened, electric links running inside of the supporting device from the electrical connector towards an end configured to be connected to the logging probe, fluid communication openings between the inner space of the rods and the outside of the supporting device, the fluid communication openings being arranged between the probe and the electrical connector, and a tilting shutter provided between the fluid communication openings and the electrical connector allowing fluid circulation from the inside towards the outside and preventing circulation from the outside towards the inside of the supporting device, wherein the electric links run past an area of the tilting shutter between an outer periphery of the tilting shutter and an outer body wall of the supporting device.

7. The device as claimed in claim 6, wherein a line provides pressure balance of the electrical connector and contacts for electrical connection with the probe.

8. The device as claimed in a claim 6, further comprising a return spring to keep the tilting shutter closed to prevent circulation from the outside towards the inside of the supporting device.

9. The device as claimed in claim 6, further comprising a latch that can be set to keep the tilting shutter open.

10. The device as claimed in claim 9, wherein said latch is actuated manually.

* * * * *